US010470568B1

(12) United States Patent
Chen et al.

(10) Patent No.: US 10,470,568 B1
(45) Date of Patent: Nov. 12, 2019

(54) ADJUSTMENT MECHANISM FOR SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Fang-Cheng Su, Kaohsiung (TW); Ci-Bin Huang, Kaohsiung (TW); Yue-Hua Tang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 16/220,404

(22) Filed: Dec. 14, 2018

(30) Foreign Application Priority Data

Aug. 23, 2018 (TW) ..... 107129884 A

(51) Int. Cl.
*A47B 88/00* (2017.01)
*A47B 88/407* (2017.01)

(52) U.S. Cl.
CPC ..... *A47B 88/407* (2017.01)

(58) Field of Classification Search
CPC ..... A47B 88/407; A47B 88/427; A47B 2088/4272; A47B 2088/4274; A47B 2088/4276; A47B 2088/4278
See application file for complete search history.

(56) References Cited

U.S. PATENT DOCUMENTS 6,945,618 B2 * 9/2005 Kim ..... A47B 88/427 312/334.4
8,727,460 B2 * 5/2014 Grabher ..... E05F 5/02 312/333
8,854,769 B1 * 10/2014 Liang ..... A47B 88/427 360/125.51
10,149,539 B2 * 12/2018 McGregor ..... A47B 88/49
2007/0138924 A1 * 6/2007 Lautenschlager ..... F16B 12/46 312/348.2
2012/0292465 A1 * 11/2012 Holzer ..... A47B 88/427 248/201
2013/0113356 A1 * 5/2013 Salice ..... A47B 88/427 312/334.44
2013/0293078 A1 * 11/2013 Haemmerle ..... A47B 88/956 312/333
2014/0314347 A1 * 10/2014 Huang ..... A47B 88/427 384/22
2017/0172299 A1 * 6/2017 Schneider ..... F16C 29/001
2018/0255925 A1 * 9/2018 Chen ..... F16C 29/005

FOREIGN PATENT DOCUMENTS

CN 204363436 U 6/2015

* cited by examiner

*Primary Examiner* — Matthew W Ing
(74) *Attorney, Agent, or Firm* — Rosenberg, Klein & Lee

(57) ABSTRACT

An adjustment mechanism includes an adjustment device. The adjustment device includes a first component, a second component, and an adjusting element. The first component includes a first feature. The adjusting element is arranged on the second component and includes a second feature. When the adjusting element is operated, the first feature and the second feature work with each other to longitudinally displace, and thereby adjust, the second component and the first component with respect to each other.

16 Claims, 10 Drawing Sheets

ADJUSTMENT MECHANISM FOR SLIDE RAIL ASSEMBLY

FIELD OF THE INVENTION

The present invention relates to an adjustment mechanism and more particularly to an adjustment mechanism that enables longitudinal adjustment.

BACKGROUND OF THE INVENTION

Generally, an undermount drawer slide rail assembly is mounted on a bottom portion of a drawer and is therefore hidden from view. Such a slide rail assembly typically includes a first rail and a second rail that can be displaced with respect to the first rail, wherein the first rail is mounted on the body of a cabinet while the second rail serves to carry or support a drawer so that the drawer can be easily pulled out of and pushed back into the cabinet body via the second rail with respect to the first rail. When the drawer is pulled out of the cabinet body, the undermount drawer slide rail assembly stays hidden at the bottom of the drawer.

It is well known in the art of furniture slide rails that a drawer can be adjusted, or displaced, with respect to the cabinet body in which it is installed (or with respect to certain slide rails). U.S. Pat. No. 9,060,604 B2, for example, discloses a device (10) for laterally centering a drawer. The device (10) includes a first coupling part (26) and a second coupling part (27), which are respectively connected to a hooking device (12) of a drawer (13) and a pull-out guide (11). The first coupling part (26) and the second coupling part (27) are conformed with elastically yieldable means in a lateral direction in order to cause a forced engagement and/or a shaped engagement between the first coupling part (26) and the second coupling part (27), thereby compensating for any lateral play between the hooking device (12) and the pull-out guide (11). As another example, Chinese Patent No. 204363436 U discloses an adjustment device (8) that can be fixed on a known coupling device (9) without using tools. The coupling device (9) can be mounted on a drawer (2) in advance. The adjustment device (8) allows the drawer (2), and hence its front panel (5), to be adjusted in position along the depth direction of the body (4) of a piece of furniture. The disclosures of the afore-cited patents are incorporated herein by reference.

SUMMARY OF THE INVENTION

The present invention relates to an adjustment mechanism that enables longitudinal adjustment.

According to one aspect of the present invention, an adjustment mechanism includes an adjustment device. The adjustment device includes a first component, a second component, and a first adjusting element. The first portion includes a first feature. The first adjusting element is disposed on the second component and includes a second feature. When the first adjusting element is operated, the first feature and the second feature work with each other to longitudinally displace, and thereby adjust, the second component and the first component with respect to each other.

Preferably, the first component includes a first portion and a second portion connected to the first portion.

Preferably, the first feature of the first component includes at least one projection, and the second feature of the first adjusting element includes a generally spiral guiding portion, wherein the at least one projection is configured to be pressed against the guiding portion.

Preferably, the first feature of the first component includes a plurality of projections arranged at intervals, and the guiding portion can extend through each interval and be engaged between each two adjacent projections.

Preferably, the projections are substantially longitudinally arranged.

Preferably, the first component includes an extension section, and one of the extension section and the second component includes a guide channel for accommodating the other of the extension section and the second component.

Preferably, the first component includes an extension section, one of the extension section and the second component has a position-limiting space, and a shaft is inserted into a portion of the position-limiting space and connected with the other of the extension section and the second component to enable limited longitudinal displacement of the second component with respect to the first component.

Preferably, the extension section is disposed on the second portion of the first component.

Preferably, the first adjusting element is a turning wheel, and the shaft is pivotally connected to the center of the generally spiral guiding portion of the first adjusting element and the second component.

Preferably, the adjustment mechanism further includes a coupling device, and the adjustment device is connected to the coupling device in a detachable manner.

Preferably, the coupling device includes a second adjusting element, and the second adjusting element is disposed in a direction substantially perpendicular to the direction in which the first adjusting element is disposed.

Preferably, the second adjusting element is a turning wheel.

According to another aspect of the present invention, a slide rail assembly is adapted for a piece of furniture that includes a first furniture part and a second furniture part. The slide rail assembly includes a first rail, a second rail, and an adjustment mechanism according to any of the aforesaid embodiments. The first rail is configured to be fixed on the first furniture part. The second rail can be longitudinally displaced with respect to the first rail and is configured to carry the second furniture part. When the second rail is retracted with respect to the first rail and the second component is at a first longitudinal position with respect to the first component, the second component abuts against the first rail, with a first longitudinal distance between a front portion of the second furniture part and a front portion of the first furniture part. When the second rail is retracted with respect to the first rail and the second component is at a second longitudinal position with respect to the first component instead, the second component abuts against the first rail, with a second longitudinal distance between the front portion of the second furniture part and the front portion of the first furniture part, wherein the second longitudinal distance is different from the first longitudinal distance.

Preferably, the coupling device is disposed on the second rail, and the first component is fixed to the coupling device.

DETAILED DESCRIPTION OF THE INVENTION

Figure 1:
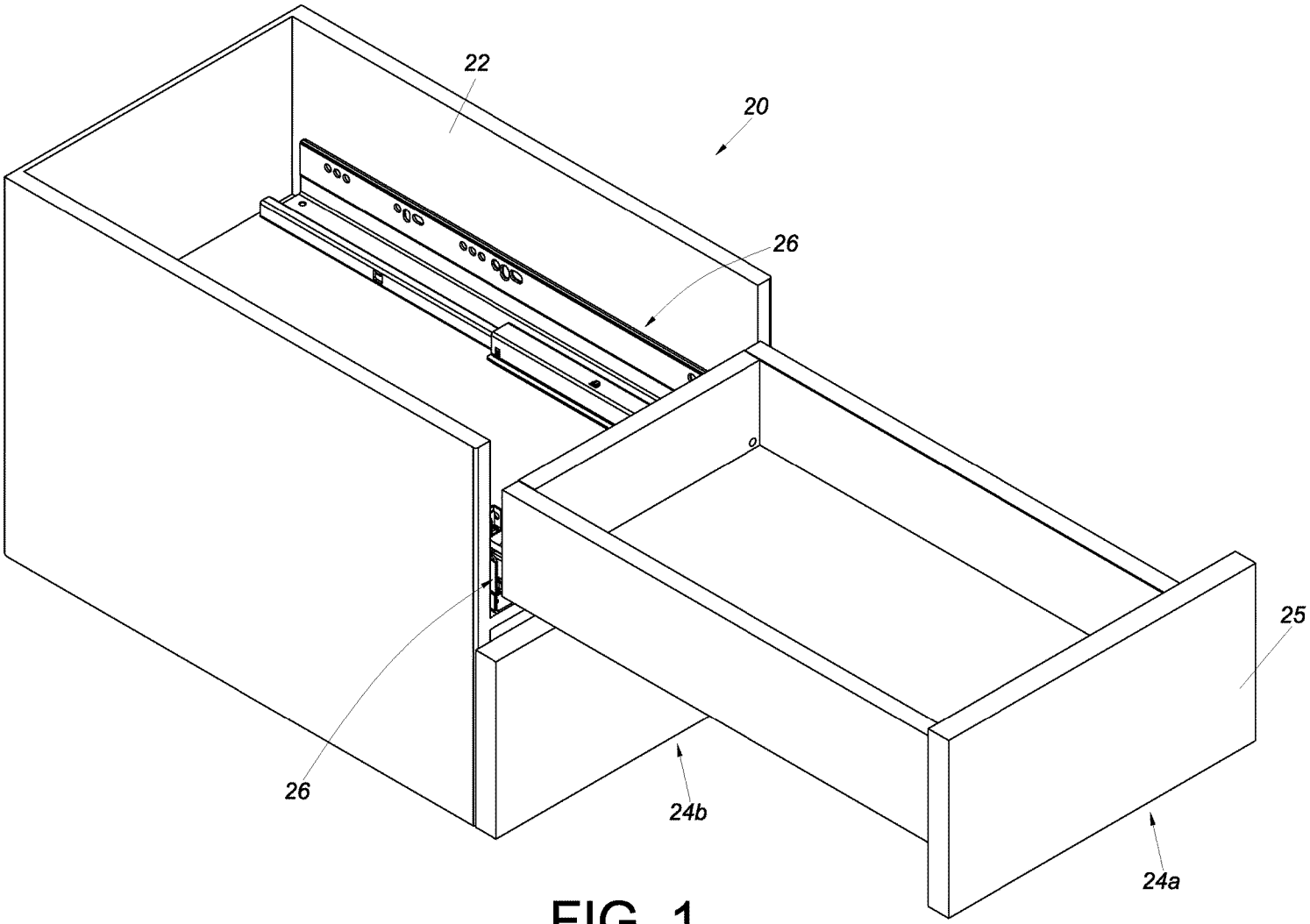
FIG. 1 is a perspective view of a piece of furniture according to an embodiment of the present invention, wherein the furniture includes a first furniture part and two second furniture parts, and wherein one of the second furniture parts is pulled out of the first furniture part via a pair of slide rail assemblies.
Figure 2:
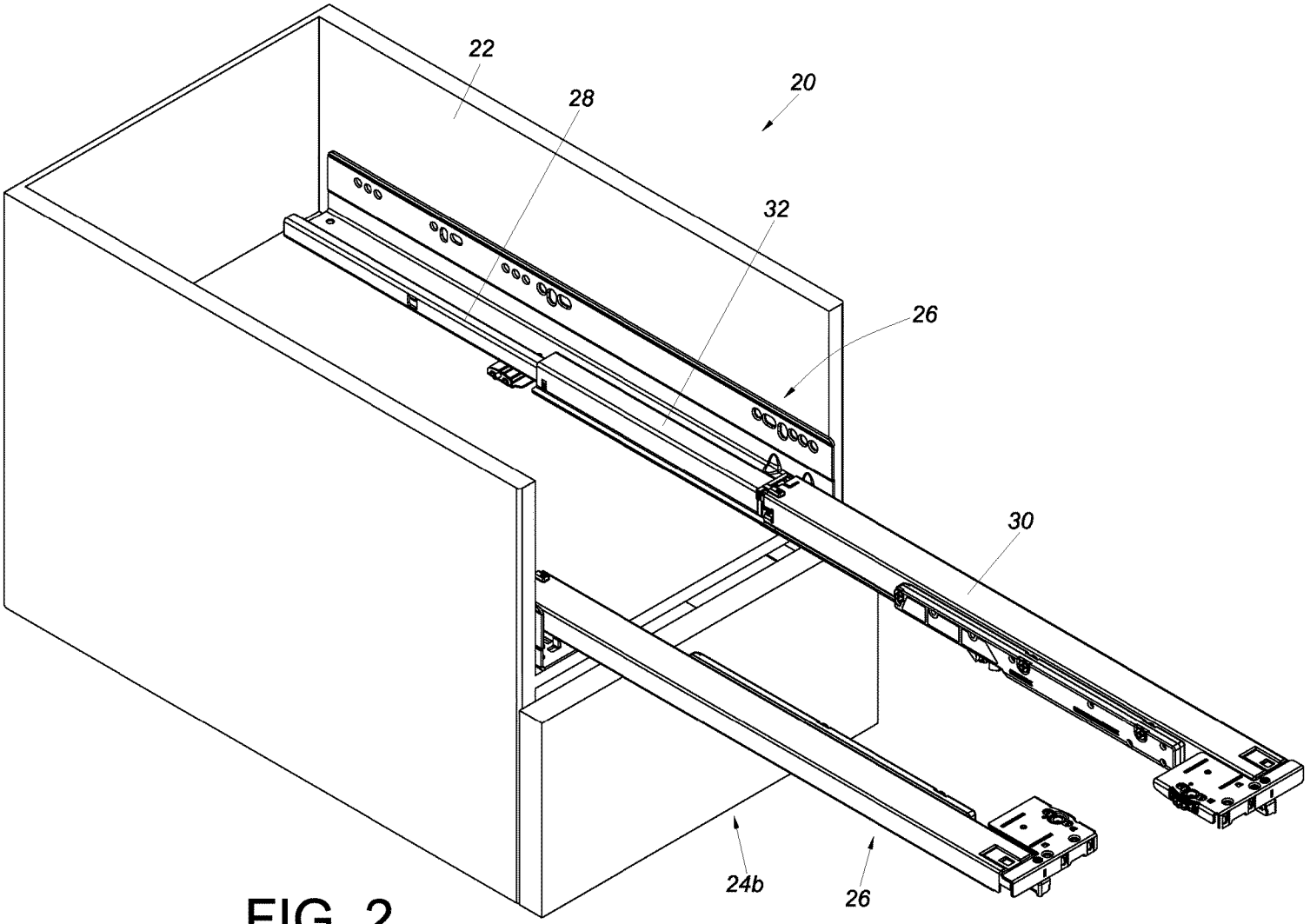
FIG. 2 is similar to FIG. 1 except that the pulled-out second furniture part is removed.

Referring to FIG. 1 and FIG. 2, a piece of furniture 20 includes a first furniture part 22 and at least one second furniture part. Here, two second furniture parts 24*a*, 24*b* are shown by way of example. Each of the second furniture parts, such as the second furniture part 24*a*, can be displaced with respect to the first furniture part 22. Preferably, the second furniture part 24*a* can be easily displaced with respect to the first furniture part 22 via a pair of slide rail assemblies 26. The first furniture part 22 may be the body of a furniture cabinet, and the two second furniture parts 24*a*, 24*b* may be drawers; the present invention has no limitation in this regard. The second furniture part 24*a* is mounted on the first furniture part 22 through the pair of slide rail assemblies 26 in a movable manner. The slide rails of each slide rail assembly 26 are mounted on a bottom portion of the second furniture part 24*a* to form a so-called undermount slide rail assembly. More specifically, each slide rail assembly 26 includes a first rail 28, a second rail 30 longitudinally displaceable with respect to the first rail 28, and preferably also a third rail 32 movably mounted between the first rail 28 and the second rail 30 to increase the distance for which the second rail 30 can be displaced with respect to the first rail 28. The first rails 28 are fixedly mounted on the first furniture part 22. The second rails 30 are configured to carry the second furniture part 24*a* (or an object to be carried) so that the second furniture part 24*a* can be easily displaced via the second rails 30 from inside the first furniture part 22 to a position outside the first furniture part 22 and vice versa.

Figure 3:
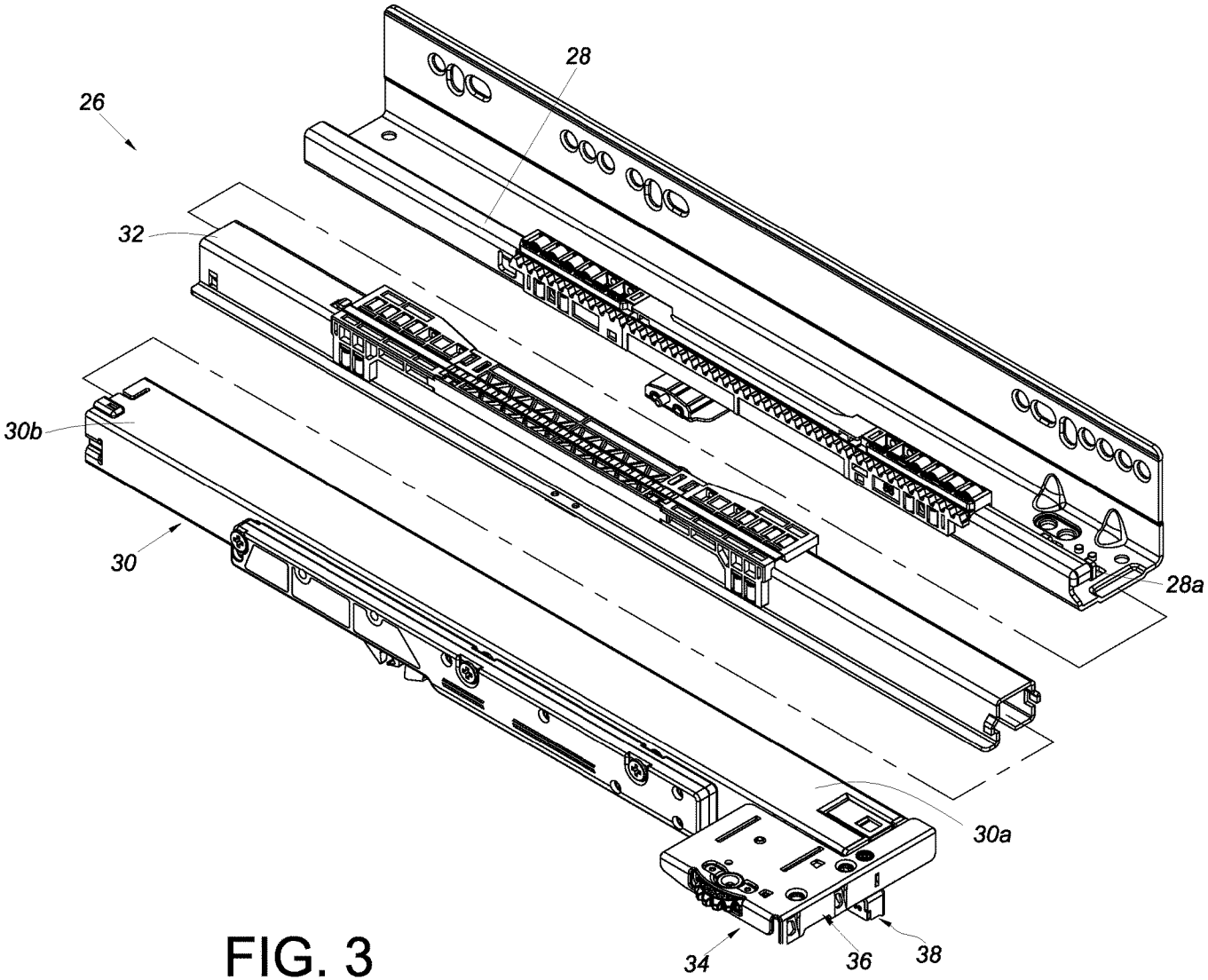
FIG. 3 is an exploded perspective view of the slide rail assembly according to the embodiment of the present invention.
Figure 4:
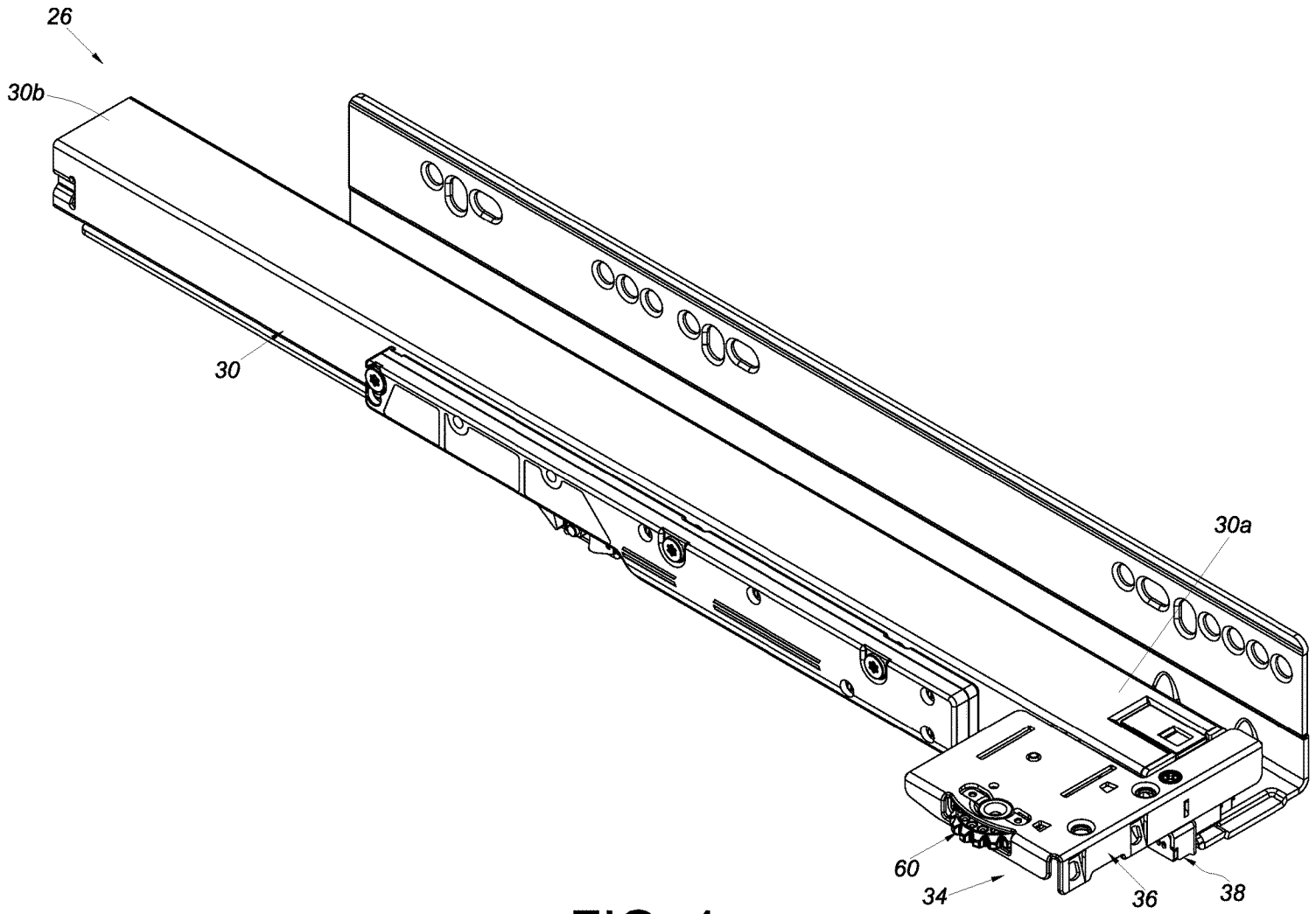
FIG. 4 is an assembled perspective view of the slide rail assembly according to the embodiment of the present invention.
Figure 5:
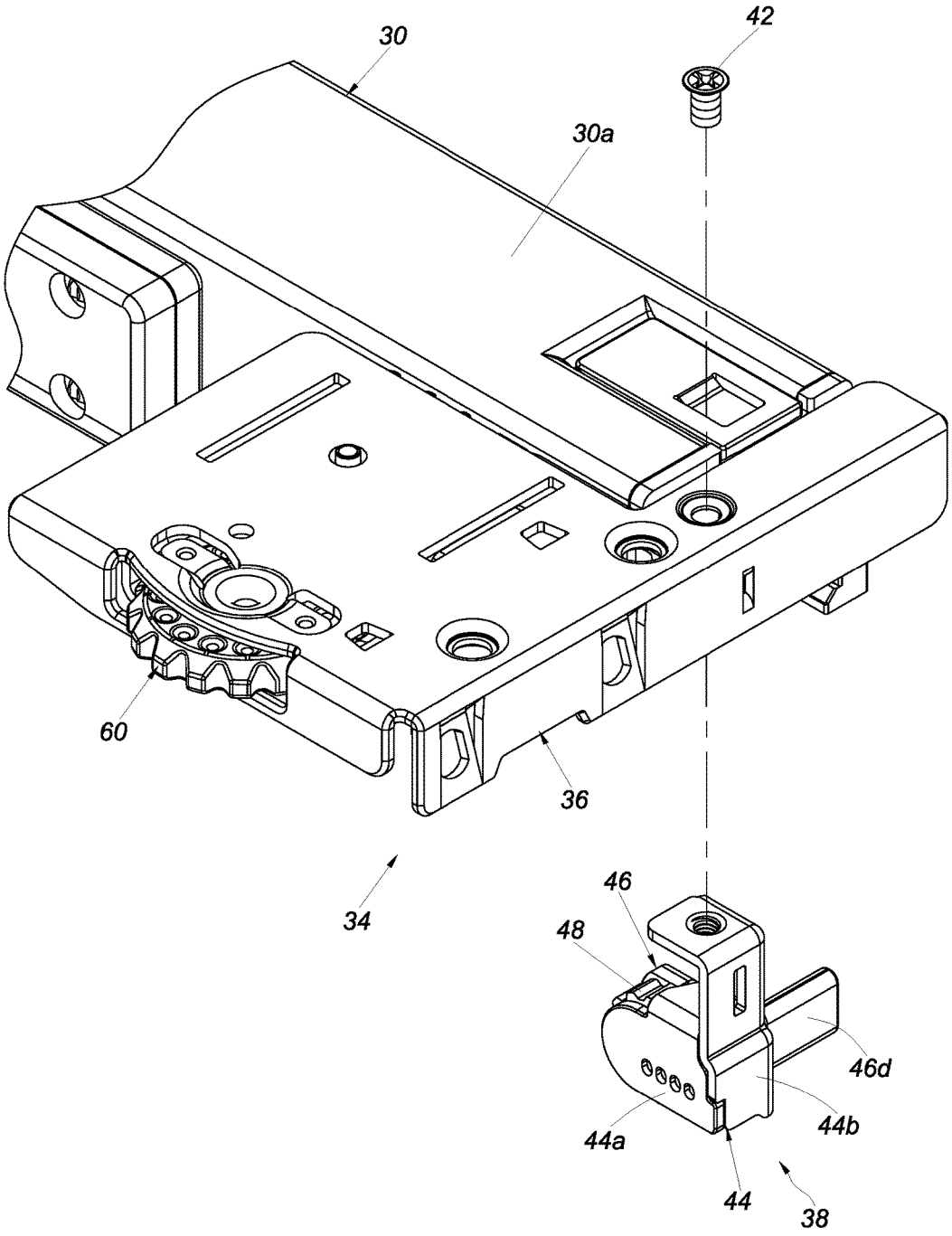
FIG. 5 is a perspective view showing the adjustment device and the coupling device of the adjustment mechanism of the slide rail assembly in an exploded view, with the coupling device arranged on the second rail.

As shown in FIG. 3, FIG. 4, and FIG. 5, the slide rail assembly 26 further includes an adjustment mechanism 34. The adjustment mechanism 34 includes an adjustment device 38 and preferably also a coupling device 36. The coupling device 36 is arranged between a front end 30*a* and a rear end 30*b* of the second rail 30. Here, the coupling device 36 is arranged adjacent to the front end 30*a* of the second rail 30 by way of example. The adjustment device 38 is connected to the coupling device 36. Here, the adjustment device 38 is detachably connected to the coupling device 36 by a fixing member 42 (e.g., a screw). In other embodiments, the adjustment device 38 may be integrated with the coupling device 36 instead. The present invention has no limitation on how to connect the adjustment device 38 to the coupling device 36.

Figure 6:
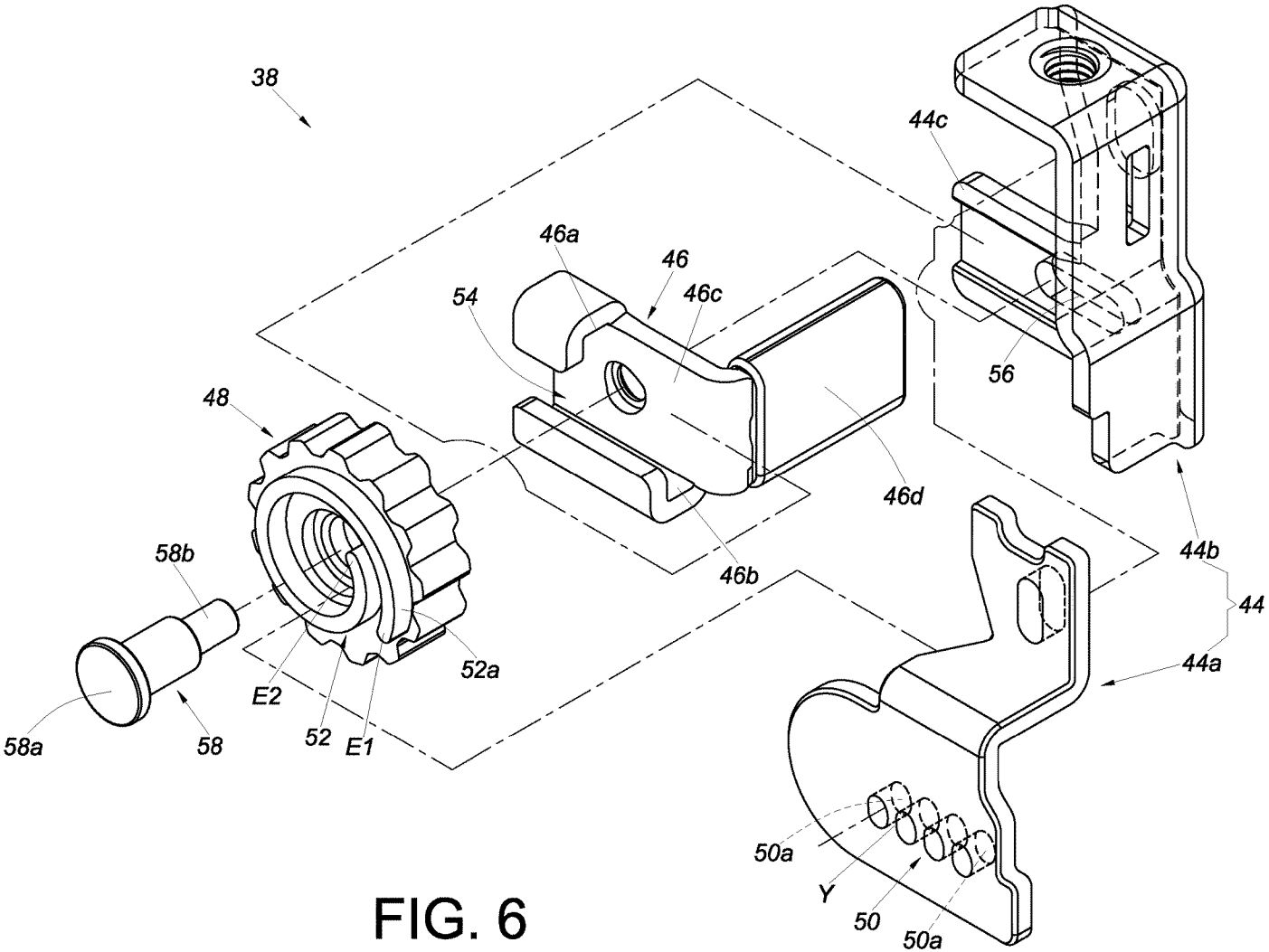
FIG. 6 is an exploded perspective view of the adjustment device according to the embodiment of the present invention.
Figure 7:
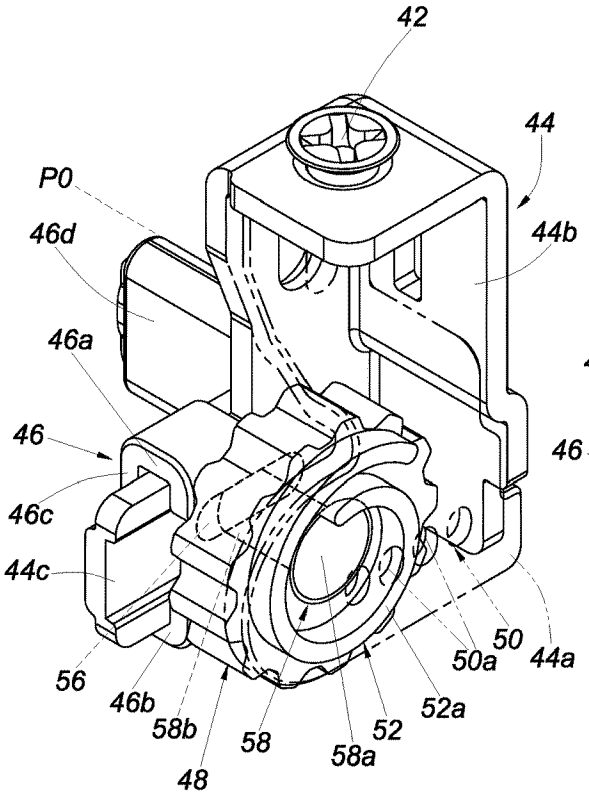
FIG. 7 is a schematic perspective view of the adjustment device according to the embodiment of the present invention, wherein the second component of the adjustment device is at a predetermined position with respect to the first component.

As shown in FIG. 5, FIG. 6, and FIG. 7, the adjustment device 38 includes a first component 44, a second component 46, and a first adjusting element 48.

The first component 44 is connected to the coupling device 36 by the fixing member 42. The first component 44 includes a first portion 44*a* and a second portion 44*b* connected to the first portion 44*a*. Preferably, the first portion 44*a* is fixed to the second portion 44*b* by an insertion-based connection means, an engagement-based connection means, riveting, soldering, or threaded connection. The first portion 44*a* has a first feature 50. The first adjusting element 48 is arranged on the second component 46 and includes a second feature 52.

Preferably, the first feature 50 of the first component 44 includes at least one projection 50*a* (here, a plurality of projections 50*a* are shown by way of example), and the second feature 52 of the first adjusting element 48 includes a generally spiral guiding portion 52*a*, wherein the guiding portion 52*a* has a first end E1 and a second end E2. The projections 50*a* are configured to be pressed against the guiding portion 52*a*. Preferably, the projections 50*a* of the first component 44 are arranged at intervals Y, and the guiding portion 52*a* of the first adjusting element 48 can pass through each interval Y and be engaged between each two adjacent projections 50*a*.

Preferably, the projections 50*a* are substantially longitudinally arranged.

Preferably, the second portion 44*b* of the first component 44 has an extension section 44*c*, and one of the extension section 44*c* and the second component 46 has a guide channel 54. Here, the second component 46 has the guide channel 54 by way of example. More specifically, the second component 46 includes a first wall 46*a*, a second wall 46*b*, a middle wall 46*c*, and a stopping portion 46*d*. The first wall 46*a*, the second wall 46*b*, and the middle wall 46*c* jointly define the guide channel 54 for accommodating the extension section 44*c* of the second portion 44*b* of the first component 44. The stopping portion 46*d* is bent with respect to the middle wall 46*c*. Here, the stopping portion 46*d* is substantially perpendicularly connected to the middle wall 46*c* by way of example but not limitation.

Preferably, one of the extension section 44*c* of the second portion 44*b* of the first component 44 and the second component 46 has a position-limiting space 56 (e.g., a longitudinal hole or groove). Here, the extension section 44*c* of the second portion 44*b* of the first component 44 has the position-limiting space 56 by way of example, and a shaft 58 is inserted into a portion of the position-limiting space 56 and connected with the second component 46 so that the second component 46 can be longitudinally displaced with respect to the first component 44 to a limited extent. More specifically, the first adjusting element 48 is a turning wheel, and the shaft 58 is pivotally connected to the center of the generally spiral guiding portion 52*a* of the first adjusting element 48 and the second component 46. Preferably, the shaft 58 includes a head 58*a* and a body 58*b* connected to the head 58*a*, wherein the head 58*a* is larger than the body 58*b*. The body 58*b* extends through the first adjusting element 48 and the second component 46 and is inserted into a portion of the position-limiting space 56 of the first component 44, with the head 58*a* stopped on one side of the first adjusting element 48.

FIG. 7 shows the second component 46 and the first component 44 at predetermined positions with respect to each other. Here, by way of example, the second component 46 is at a predetermined position P0 with respect to the first component 44.

Figure 8:
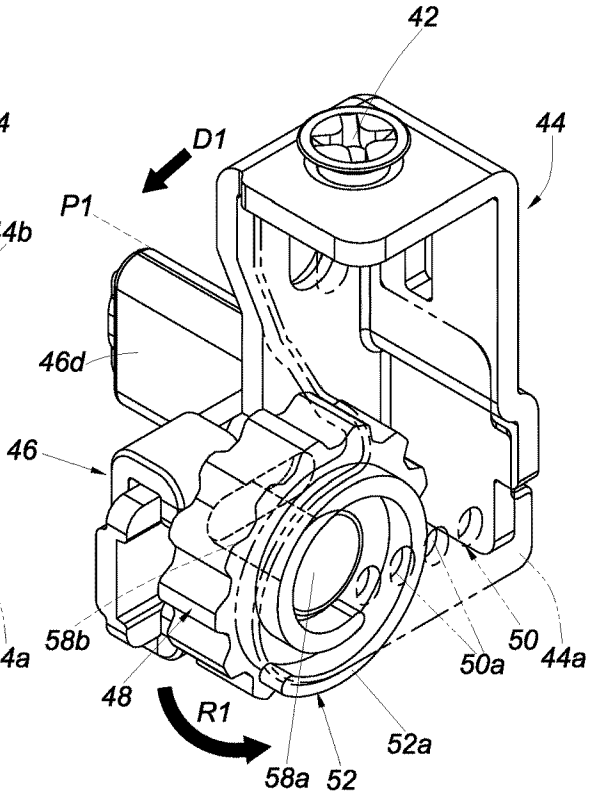
FIG. 8 is a schematic perspective view of the adjustment device according to the embodiment of the present invention, wherein the second component of the adjustment device is adjusted in a first direction with respect to the first component to a first longitudinal position.

Referring to FIG. 8 in conjunction with FIG. 7, when the first adjusting element 48 is operated, the first feature 50 and the second feature 52 work with each other to longitudinally displace, i.e., adjust, the second component 46 and the first component 44 with respect to each other. For example, the first component 44 can be viewed as stationary with respect to the second component 46 once connected to the coupling device 36 by the fixing member 42 (in which state only the second component 46 can be longitudinally displaced with respect to the first component 44 but not the other way around). More specifically, when the first adjusting element 48 is operated by being rotated in a first rotation direction R1 (such as but not limited to a rearward rotation direction), the second feature 52 is pressed against the first feature 50 and thereby generates a force that displaces the second component 46 longitudinally with respect to the first component 44 in a first direction D1 (e.g., toward the rear) from the predetermined position P0 to a first longitudinal position P1.

Figure 9:
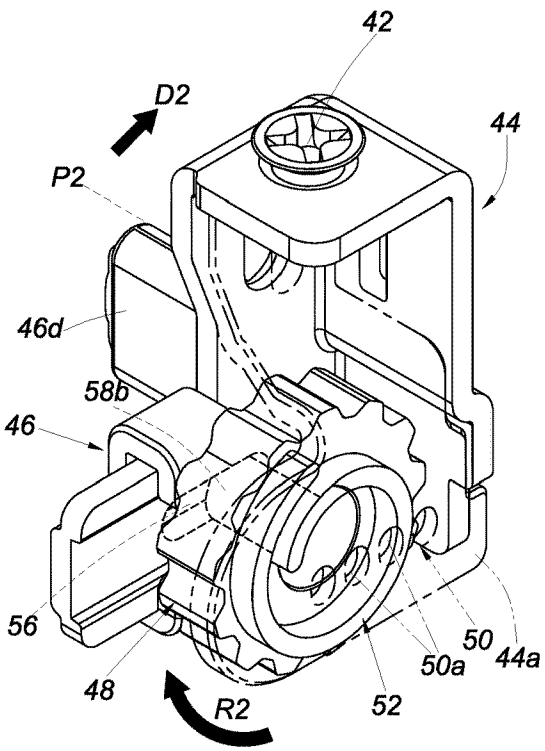
FIG. 9 is a schematic perspective view of the adjustment device according to the embodiment of the present invention, wherein the second component of the adjustment device is adjusted in a second direction with respect to the first component to a second longitudinal position.

Referring to FIG. 9, when the first adjusting element 48 is operated by being rotated in a second rotation direction R2 (such as but not limited to a forward rotation direction) instead, the second feature 52 is pressed against the first feature 50 and thereby generates a force that displaces the second component 46 longitudinally with respect to the first component 44 in a second direction D2 (e.g., toward the front) from the predetermined position P0 to a second longitudinal position P2.

Figure 10:
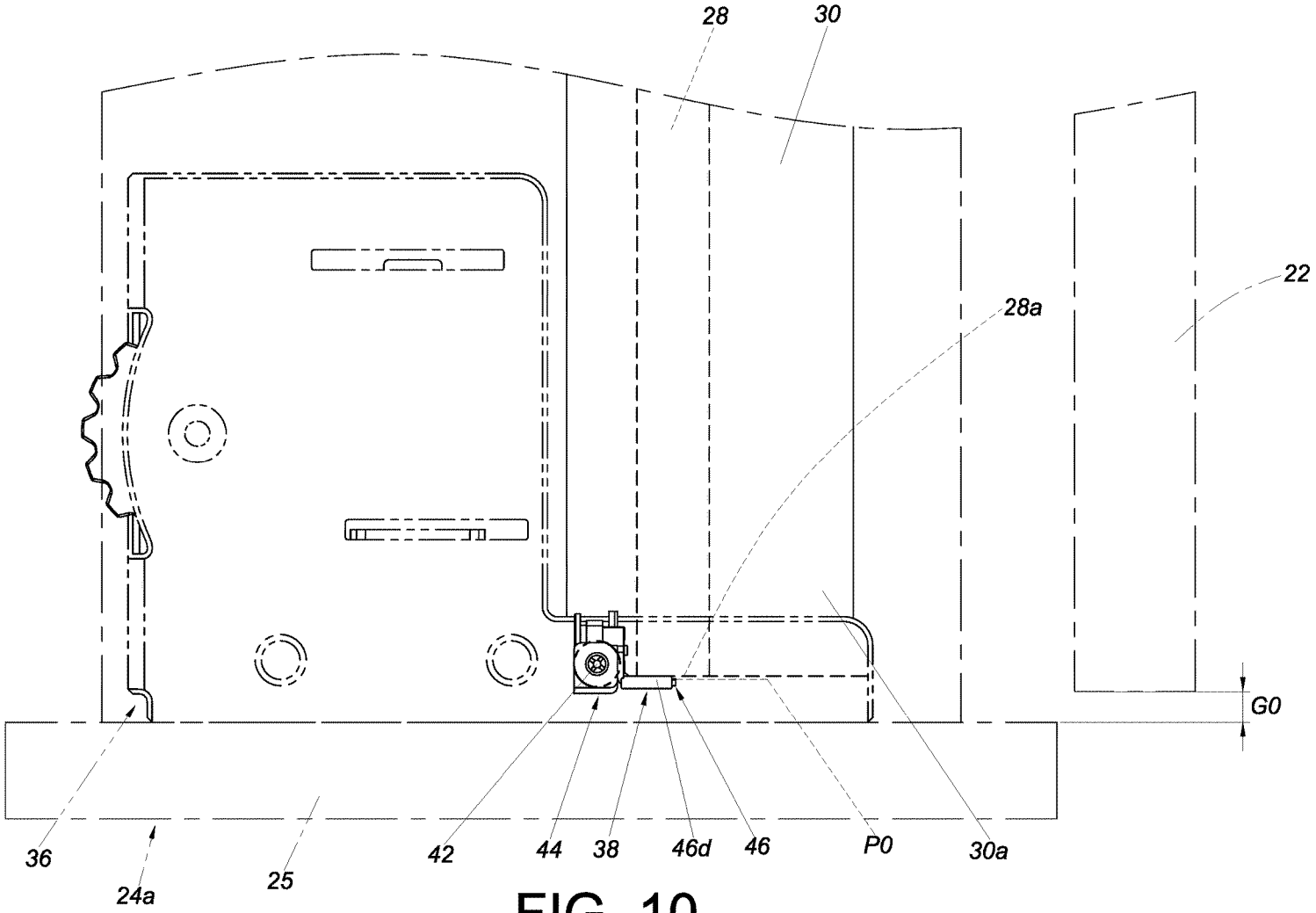
FIG. 10 is a schematic perspective view of the adjustment device according to the embodiment of the present invention, showing that the second component of the adjustment device is at the predetermined position with respect to the first component, with a predetermined distance defined between a front portion of the corresponding second furniture part and a front portion of the first furniture part.

As shown in FIG. 10, the coupling device 36 is arranged on the second rail 30 at a position adjacent to the front end 30*a* of the second rail 30, with the second rail 30 carrying the second furniture part 24*a*. The adjustment device 38 is connected to the coupling device 36 by the fixing member 42. When the second rail 30 is retracted with respect to the first rail 28, and the second component 46 of the adjustment device 38 is at the predetermined position P0 with respect to the first component 44, the stopping portion 46*d* of the second component 46 abuts against a front end 28*a* of the first rail 28, with a predetermined distance G0 defined between a front portion (e.g., a front panel 25) of the second furniture part 24*a* and a front portion of the first furniture part 22.

Figure 11:
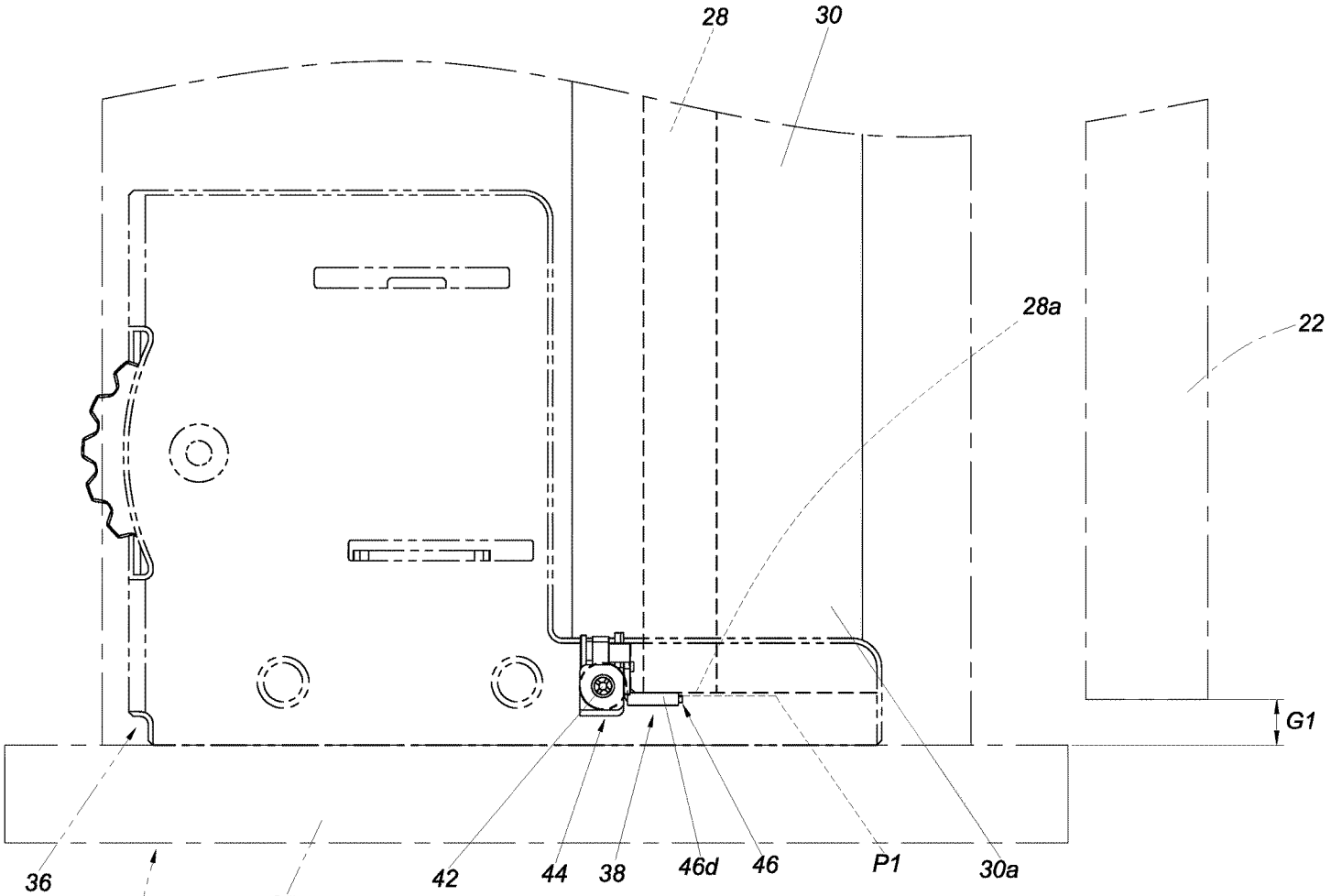
FIG. 11 is a schematic perspective view of the adjustment device according to the embodiment of the present invention, showing that the second component of the adjustment device is at the first longitudinal position with respect to the first component, with a first longitudinal distance defined between the front portion of the corresponding second furniture part and the front portion of the first furniture part.

Referring to FIG. 11, when the second rail 30 is retracted with respect to the first rail 28, and the second component 46 of the adjustment device 38 is adjusted to the first longitudinal position P1 with respect to the first component 44 (see FIG. 8), the stopping portion 46*d* of the second component 46 abuts against the front end 28*a* of the first rail 28, with a first longitudinal distance G1 defined between the front portion (e.g., the front panel 25) of the second furniture part 24*a* and the front portion of the first furniture part 22. Here, the first longitudinal distance G1 is greater than the predetermined distance G0 by way of example.

Figure 12:
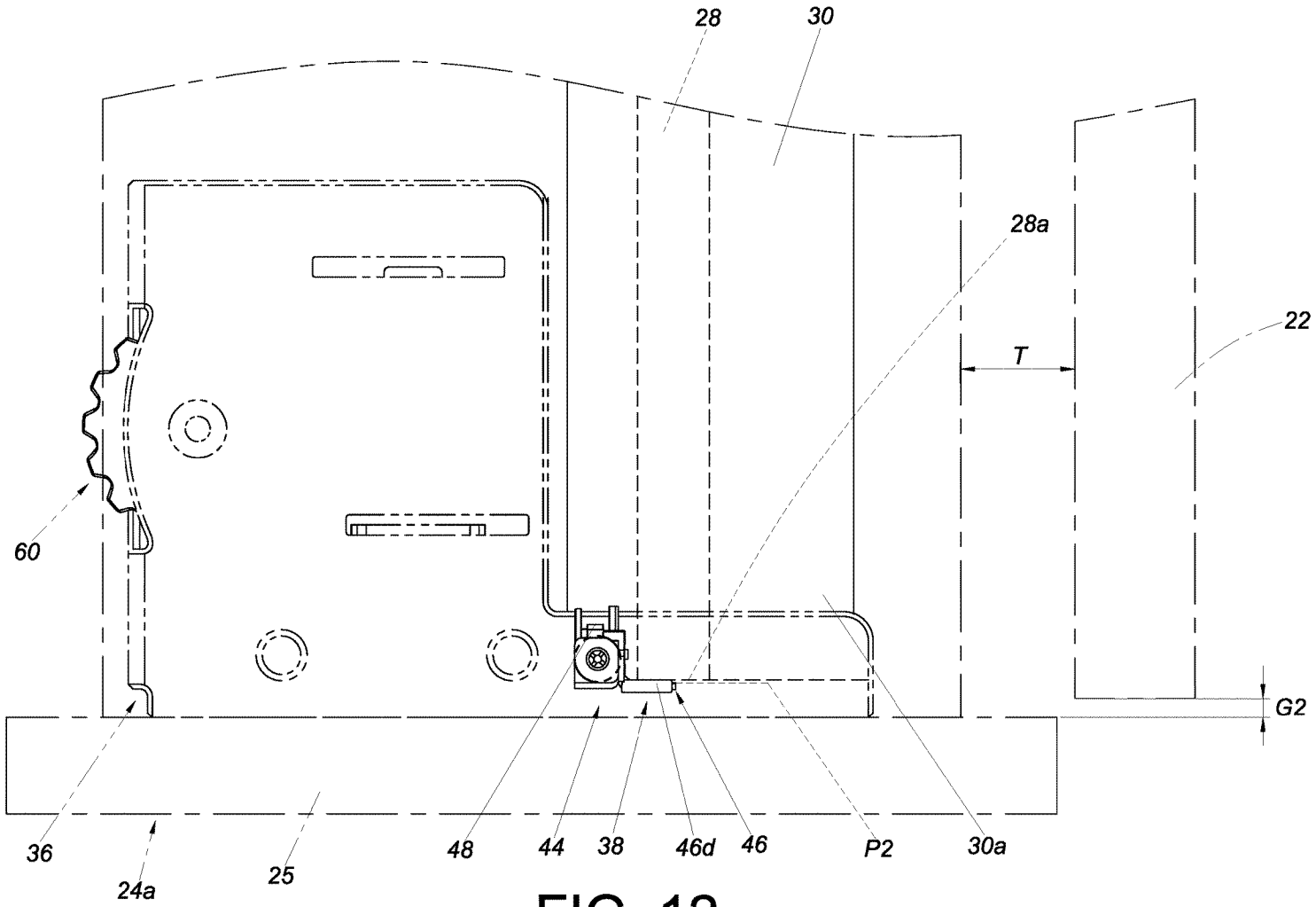
FIG. 12 is a schematic perspective view of the adjustment device according to the embodiment of the present invention, showing that the second component of the adjustment device is at the second longitudinal position with respect to the first component, with a second longitudinal distance defined between the front portion of the corresponding second furniture part and the front portion of the first furniture part.

Referring to FIG. 12, when the second rail 30 is retracted with respect to the first rail 28, and the second component 46 of the adjustment device 38 is adjusted to the second longitudinal position P2 with respect to the first component 44 (see FIG. 9), the stopping portion 46*d* of the second component 46 abuts against the front end 28*a* of the first rail 28, with a second longitudinal distance G2 defined between the front portion (e.g., the front panel 25) of the second furniture part 24*a* and the front portion of the first furniture part 22. Here, the second longitudinal distance G2 is smaller than the predetermined distance G0 by way of example.

It is worth mentioning that the coupling device 36 includes a second adjusting element 60 (see FIG. 5), such as a turning wheel. Preferably, the second adjusting element 60 is disposed in a direction substantially perpendicular to the direction in which the first adjusting element 48 is disposed so that the axis of the second adjusting element 60 is substantially perpendicular to that of the first adjusting element 48. The second adjusting element 60 can be used to effect a transverse displacement T, and hence transverse adjustment, of the second furniture part 24*a* with respect to the first furniture part 22. Such transverse adjustment is well known in the art and therefore will not be explained in more detail.

It can be known from the above that the adjustment device 38 in the foregoing embodiment preferably has the following features:

1. When the first adjusting element 48 of the adjustment device 38 is operated (e.g., rotated), the second component 46 and the first component 44 are longitudinally displaced (i.e., adjusted) with respect to each other through cooperation between the first feature 50 and the second feature 52. This allows the longitudinal distance between the second furniture part 24*a* and the first furniture part 22 to be adjusted to deal with or compensate for mounting errors that may exist between the second furniture part 24*a* and the first furniture part 22 (or a slide rail).
2. The coupling device 36 is arranged on the second rail 30, and the adjustment device 38 is connected to the coupling device 36. The coupling device 36 and the adjustment device 38 make up an adjustment mechanism.
3. Intuitive operation is made possible by the fact that the second component 46 is displaced with respect to the first component 44 in the first direction D1 (e.g., toward the rear) when the first adjusting element 48 is rotated in the first rotation direction R1 (e.g., a rearward rotation direction), and that the second component 46 is displaced with respect to the first component 44 in the second direction D2 (e.g., toward the front) when the first adjusting element 48 is rotated in the second rotation direction R2 (e.g., a forward rotation direction).

While the present invention has been disclosed through the preferred embodiment described above, the embodiment is not intended to be restrictive of the scope of the invention. The scope of patent protection sought by the applicant is defined by the appended claims.

What is claimed is:

1. An adjustment mechanism, comprising:

an adjustment device including:

a first component including a first portion and a second portion connected to the first portion, wherein the first portion includes a first feature, the first feature includes at least one projection, and the second portion includes an extension section;

a second component, one of the extension section and the second component having a position-limiting space, and a shaft inserted into a portion of the position-limiting space being connected with the other of the extension section and the second component, the second component being thereby longitudinally displaceable with respect to the first component to a limited extent; and a first adjusting element arranged on the second component and including a second feature, the second feature of the first adjusting element including a guiding portion having a spiral contour, and the at least one projection of the first portion of the first component presses against the guiding portion;

wherein when the first adjusting element is operated, the first feature and the second feature work with each other to longitudinally displace and thereby adjust the second component with respect to the first component.

2. The adjustment mechanism of claim 1, wherein the at least one projection includes a plurality of projections, the projections are arranged at intervals, and the guiding portion extends through each said interval to be engaged between each two adjacent said projections.

3. The adjustment mechanism of claim 2, wherein the projections are substantially longitudinally arranged.

4. The adjustment mechanism of claim 1, wherein one of the extension section and the second component has a guide channel for accommodating the other of the extension section and the second component.

5. The adjustment mechanism of claim 1, wherein the first adjusting element is a turning wheel, and the shaft is pivotally connected to a center of the guiding portion of the first adjusting element and the second component.

6. The adjustment mechanism of claim 1, further comprising a coupling device, wherein the adjustment device is connected to the coupling device.

7. The adjustment mechanism of claim 6, wherein the coupling device includes a second adjusting element, and the second adjusting element is disposed in a direction substantially perpendicular to a direction in which the first adjusting element is disposed.

8. The adjustment mechanism of claim 7, wherein the second adjusting element is a turning wheel.

9. A slide rail assembly adapted for a piece of furniture, the slide rail assembly comprising:

a first rail fixed on a first furniture part of the furniture;

a second rail longitudinally displaceable with respect to the first rail, wherein the second rail carries a second furniture part of the furniture; and an adjustment mechanism including:

a coupling device disposed on the second rail; and an adjustment device including:

a first component fixed on the coupling device and including a first feature and an extension section, the first feature including at least one projection;

a second component, one of the extension section and the second component having a position-limiting space, and a shaft inserted into a portion of the position-limiting space being connected with the other of the extension section and the second component, the second component being thereby longitudinally displaceable with respect to the first component to a limited extent; and a first adjusting element disposed on the second component and including a second feature, the second feature of the first adjusting element including a guiding portion having a spiral contour, and the at least one projection of the first component presses against the guiding portion;

wherein when the first adjusting element is operated, the first feature and the second feature work with each other to longitudinally displace and thereby adjust the second component with respect to the first component;

wherein when the second rail is retracted with respect to the first rail and the second component is at a first longitudinal position with respect to the first component, the second component abuts against one of the first rail and the first furniture part such that a first longitudinal distance is defined between a front portion of the second furniture part and a front portion of the first furniture part;

wherein when the second rail is retracted with respect to the first rail and the second component is at a second longitudinal position with respect to the first component, the second component abuts against one of the first rail and the first furniture part such that a second longitudinal distance different from the first longitudinal distance is defined between the front portion of the second furniture part and the front portion of the first furniture part.

10. The slide rail assembly of claim 9, wherein the at least one projection includes a plurality of projections, the projections are arranged at intervals, and the guiding portion extends through each said interval to be engaged between each two adjacent said projections.

11. The slide rail assembly of claim 10, wherein the projections are substantially longitudinally arranged.

12. The slide rail assembly of claim 9, wherein one of the extension section and the second component has a guide channel for accommodating the other of the extension section and the second component.

13. The slide rail assembly of claim 9, wherein the first adjusting element is a turning wheel, and the shaft is pivotally connected to a center of the guiding portion of the first adjusting element and the second component.

14. The slide rail assembly of claim 9, wherein the adjustment device is detachably connected to the coupling device.

15. The slide rail assembly of claim 14, wherein the coupling device includes a second adjusting element, and the second adjusting element is disposed in a direction substantially perpendicular to a direction in which the first adjusting element is disposed.

16. The slide rail assembly of claim 15, wherein the second adjusting element is a turning wheel.

* * * * *